US009702565B2

(12) United States Patent
Livchak et al.

(10) Patent No.: US 9,702,565 B2
(45) Date of Patent: Jul. 11, 2017

(54) DAMPER SUITABLE FOR LIQUID AEROSOL-LADEN FLOW STREAMS

(75) Inventors: Andrey V. Livchak, Bowling Green, KY (US); Derek W. Schrock, Bowling Green, KY (US); Darrin W. Beardslee, Bowling Green, KY (US); Andrew C. Faller, Smiths Grove, KY (US)

(73) Assignee: OY HALTO GROUP LTD., Vantaa (FI)

( * ) Notice: Subject to any disclaimer, the term of this patent is extended or adjusted under 35 U.S.C. 154(b) by 1040 days.

(21) Appl. No.: 12/248,261

(22) Filed: Oct. 9, 2008

(65) Prior Publication Data

US 2009/0093210 A1 Apr. 9, 2009

Related U.S. Application Data

(60) Provisional application No. 60/978,606, filed on Oct. 9, 2007.

(51) Int. Cl.
*F24C 15/20* (2006.01)
*F24F 13/14* (2006.01)

(52) U.S. Cl.
CPC ..... *F24C 15/2021* (2013.01); *F24C 15/2042* (2013.01); *F24F 13/1413* (2013.01)

(58) Field of Classification Search
CPC ..... F24C 15/20
USPC ..... 126/299 R; 454/264
See application file for complete search history.

(56) References Cited

U.S. PATENT DOCUMENTS 694,727 A 11/1897 Cooper
3,323,439 A 6/1967 Burllynn et al.
3,591,150 A * 7/1971 Weatherston ..... 432/47
3,941,039 A 3/1976 Kinney
3,958,605 A 5/1976 Nishizu et al.
3,967,642 A 7/1976 Logsdon
4,066,064 A 1/1978 Vandas
4,091,835 A 5/1978 Frampton
4,130,111 A 12/1978 Ristic
4,276,817 A 7/1981 Meckler
(Continued)

FOREIGN PATENT DOCUMENTS

EP 0874199 10/1998
GB 2270638 3/1994
(Continued)

OTHER PUBLICATIONS

Office Action, dated Sep. 18, 2004, in Canadian Application No. 2,640,840.

*Primary Examiner* — Steven B McAllister
*Assistant Examiner* — Samantha Miller
(74) *Attorney, Agent, or Firm* — Potomac Law Group, PLLC; Mark A. Catan

(57) ABSTRACT

A flow control device has a duct section with a plurality of damper blocking elements, each having a major plane. The damper blocking elements are pivotably connected to the duct section and movable in a range that is limited to ensure that, when the duct section is mounted in a preferred orientation, the damper blocking element major planes always form an angle of at least 45 degrees from the horizontal throughout the range. The range is such that the plurality of damper blocking elements can selectively close and open the duct. The blocking elements can completely close the duct, for example, to block natural convection.

11 Claims, 9 Drawing Sheets

(56) References Cited

U.S. PATENT DOCUMENTS

| | | | | |
|---|---|---|---|---|
| 4,552,059 | A | 11/1985 | Potter | |
| 4,633,900 | A | 1/1987 | Suzuki | |
| 4,738,243 | A | 4/1988 | Welsh et al. | |
| 4,784,114 | A | 11/1988 | Muckler et al. | |
| 4,902,316 | A | 2/1990 | Giles | |
| 4,903,894 | A | 2/1990 | Pellinen | |
| 4,912,338 | A | 3/1990 | Bingham | |
| 5,042,456 | A | 8/1991 | Cote | |
| 5,251,608 | A | 10/1993 | Cote | |
| 5,394,861 | A | 3/1995 | Stegmaier | |
| 5,421,320 | A | 6/1995 | Brown et al. | |
| 5,673,681 | A | 10/1997 | Neitzel | |
| 5,771,879 | A | 6/1998 | Saltzman | |
| 5,915,960 | A * | 6/1999 | Check et al. | 432/222 |
| 6,125,841 | A | 10/2000 | Boudreault | |
| 6,170,480 | B1 | 1/2001 | Melink et al. | |
| 6,173,710 | B1 | 1/2001 | Gibson | |
| 6,237,625 | B1 | 5/2001 | Randolph | |
| 6,349,716 | B1 | 2/2002 | Morton | |
| 6,584,968 | B1 | 7/2003 | Morton | |
| 6,708,949 | B2 | 3/2004 | Twito | |
| 6,779,735 | B1 | 8/2004 | Onstott | |
| 6,851,421 | B2 | 2/2005 | Livchak | |
| 6,866,033 | B2 | 3/2005 | Stacy et al. | |
| 6,869,468 | B2 | 3/2005 | Gibson | |
| 6,878,195 | B2 | 4/2005 | Gibson | |
| 6,899,095 | B2 | 5/2005 | Livchak | |
| 7,114,519 | B2 | 10/2006 | Aitchison et al. | |
| 7,147,168 | B1 | 12/2006 | Bagwell | |
| 7,231,967 | B2 | 6/2007 | Haglid | |
| 7,364,094 | B2 | 4/2008 | Bagwell | |
| 7,582,009 | B1 | 9/2009 | Côté | |
| 7,699,051 | B2 | 4/2010 | Gagas et al. | |
| 7,775,865 | B2 | 8/2010 | Livchak et al. | |
| 7,836,877 | B2 | 11/2010 | Gagas et al. | |
| 8,006,685 | B2 | 8/2011 | Bolton et al. | |
| 8,025,077 | B2 | 9/2011 | Lubawy | |
| 8,038,515 | B2 | 10/2011 | Livchak et al. | |
| 2002/0134371 | A1 | 9/2002 | Ward | |
| 2003/0140968 | A1 | 7/2003 | Chang | |
| 2003/0146082 | A1 | 8/2003 | Gibson | |
| 2005/0115557 | A1 | 6/2005 | Meredith et al. | |
| 2005/0116114 | A1 | 6/2005 | Aitchison et al. | |
| 2005/0229922 | A1 | 10/2005 | Magner | |
| 2005/0279845 | A1 | 12/2005 | Bagwell | |
| 2006/0032492 | A1 | 2/2006 | Bagwell | |
| 2006/0219235 | A1 | 10/2006 | Bagwell | |
| 2007/0015449 | A1 | 1/2007 | Livchak | |
| 2007/0023349 | A1 | 2/2007 | Kyllonen | |
| 2007/0068509 | A1 | 3/2007 | Bagwell | |
| 2007/0272230 | A9 | 11/2007 | Meredith | |
| 2008/0045132 | A1 | 2/2008 | Livchak | |
| 2008/0207109 | A1 | 8/2008 | Bagwell et al. | |

FOREIGN PATENT DOCUMENTS

| | | |
|---|---|---|
| WO | WO 97/48479 | 12/1997 |
| WO | WO 01/51857 | 7/2001 |
| WO | WO 02/14728 | 2/2002 |
| WO | WO 02/14746 | 2/2002 |
| WO | WO 2005/019736 | 3/2005 |
| WO | WO 2005/114059 | 12/2005 |
| WO | WO 2006/002190 | 1/2006 |
| WO | WO 2006/012628 | 2/2006 |
| WO | WO 2006/074420 | 7/2006 |
| WO | WO 2006/074425 | 7/2006 |
| WO | WO 2007/112301 | 10/2007 |
| WO | WO 2007/121461 | 10/2007 |

* cited by examiner

DAMPER SUITABLE FOR LIQUID AEROSOL-LADEN FLOW STREAMS

CROSS REFERENCE TO RELATED APPLICATIONS

The present application claims the benefit of U.S. Provisional Application No. 60/978,606, filed Oct. 9, 2007, which is hereby incorporated by reference in its entirety.

BACKGROUND

Exhaust hoods are used in many situations where pollutants are generated. Examples include kitchens, laboratories, factories, and spray paint booths, as well as other examples. In a commercial kitchen environment, multiple exhaust hoods and exhaust ducts may be provided for different appliances at different locations. The load varies with the type of appliance and the way it is being used. Broilers, grills, and fryers, for example, may produce a great deal of smoke and fumes, including grease particles and moisture. Other devices such as ovens and steam tables may produce less. To provide sufficient flow to remove pollutants without removing excessive amounts of air creates a real time flow balancing problem in the commercial kitchen environment. Typical exhaust hoods and ducting systems may be ill-suited to addressing this problem in an optimum way.

A typical exhaust hood has an inlet for fumes and air that leads to an exhaust duct. Filters may be provided at the point where air and fumes enter the duct. An exhaust plenum may also connect the hood with the exhaust duct. Hoods are often long and narrow and accommodate multiple cooking units. Variations include exhaust ceilings, wide canopy hoods, and other configurations.

Prior art systems have used flow restrictions in the path of the exhaust air to balance the flow of air and fumes. Dampers or other chokes may be used to make adjustments to the flow and real time control systems have been proposed. But fouling is a persistent problem particularly in systems that handle fumes and air with water vapor and grease particles.

SUMMARY

Generally, the invention is a blocking mechanism that has surfaces, which may or may not be planar, in which the surfaces of the blocking elements remain at angles that form angles greater than 30 degrees from the horizontal and preferably more than 30 degrees such as more than 45 degrees. Balancing dampers suitable for use in ducts carrying grease laden fumes have generally air blocking elements that move between high resistance and low resistance positions to regulate the amount of grease-laden fumes that pass through the duct.

A flow control device has a duct section with a plurality of damper blocking elements, each having a major plane. The damper blocking elements are pivotably connected to the duct section and movable in a range that is limited to ensure that, when the duct section is mounted in a preferred orientation, the damper blocking element major planes always form an angle of at least 45 degrees from the horizontal throughout the range. The range is such that the plurality of damper blocking elements can selectively close and open the duct. Preferably the blocking elements are capable of completely closing the duct, for example to block natural convection. In a variation, there are two damper blocking elements. The damper blocking elements may be configured such that they are interconnected to pivot in opposite directions and further such that edges thereof meet in the middle of the duct section when the blocking elements are in a closed position. For example, in a preferred configuration, the major planes are substantially vertical when the blocking elements are in the open position.

The blocking elements can be configured each with a flat portion, such as by means of a bend in a plate, that come into parallel abutment with each other when the blocking elements are in the closed position. The damper blocking elements pivot on bearings mounted outside the duct section. Preferably the bearings are durable and low resistance bearings such as roller or ball bearings to allow the damper to be used continuously and adjusted frequently throughout the day over a long lifetime without sticking or breaking down.

The blocking elements may be carried on shafts which are mounted to the bearings, and liquid proof seals located at the duct walls may be provided that permit the shafts to rotate while preventing fluid in the duct from escaping to the outside of the duct. The duct may be sealed against fluid within the duct escaping the duct section. The damper blocking elements pivot on bearings mounted inside the duct on one side of the duct and mounted outside the duct on the opposite side of the duct such the one side has no protrusions. A motor drive may be located on the opposite side so that the side with the bearing on the inside can present a flush outer face.

A motor drive may be configured to position the damper blocking elements and a controller configured to control the motor drive responsively to a detected fume load. The controller may be configured to control the motor drive responsively to a fume load detected by at least one of a gas sensor, an optical sensor, a temperature sensor, and a flow sensor.

Any of the foregoing variations may be applied to another flow control device with a duct section that has a plurality of damper blocking elements, each having a major plane. In this device, the damper blocking elements pivot on bearings connected to the duct section and are movable from an open position in which the blocking elements are in a vertical position in which the major planes are spaced apart and parallel to closed position in which the major planes form an angle of at least 45 degrees with the horizontal. The range is such that the plurality of damper blocking elements can selectively substantially close the duct section completely and open the duct section completely.

DETAILED DESCRIPTION OF EMBODIMENTS

Figure 1:
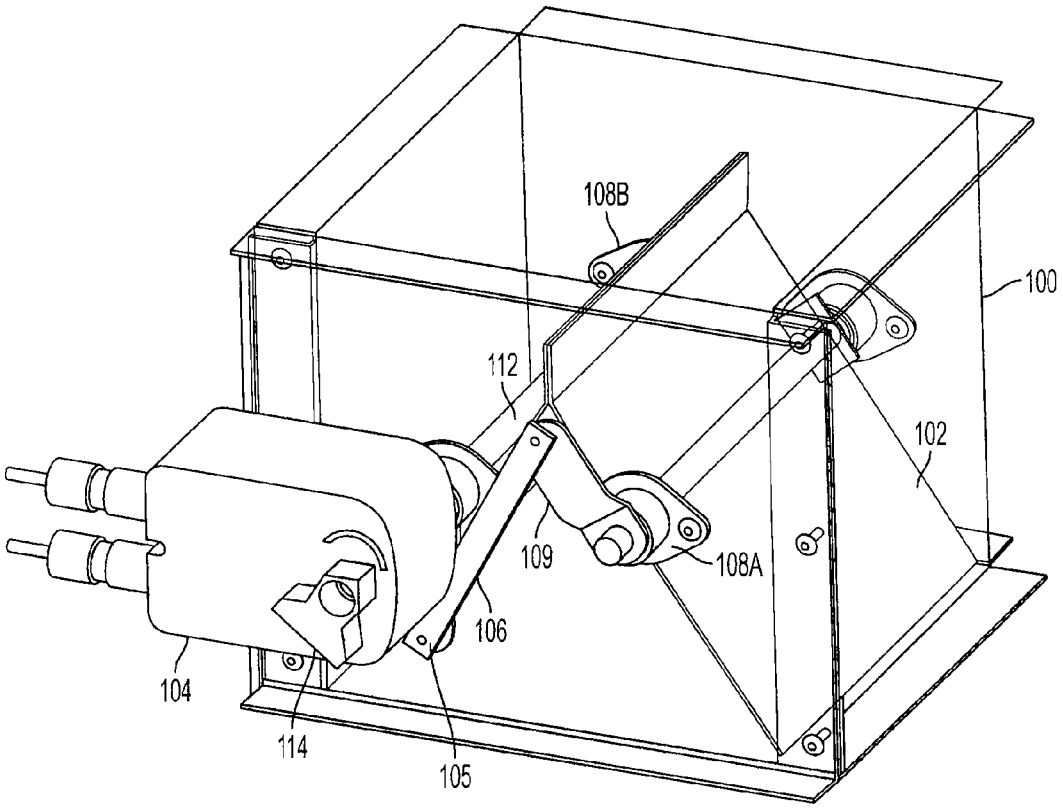
FIG. 1 shows a perspective view of a balancing damper.
Figure 2A:
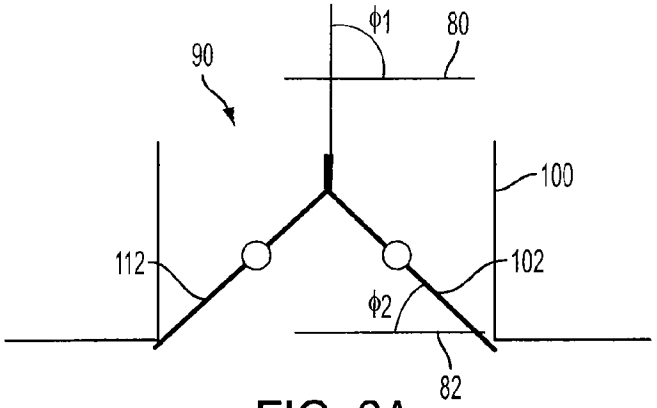
FIGS. 2A-2D are figurative views of the balancing damper blade positions in various stages of adjustment.
Figure 2B:
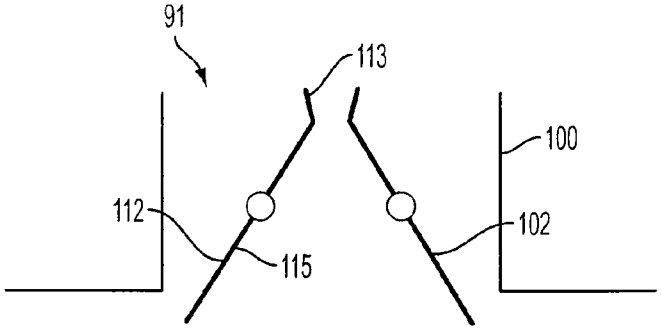
Figure 2C:
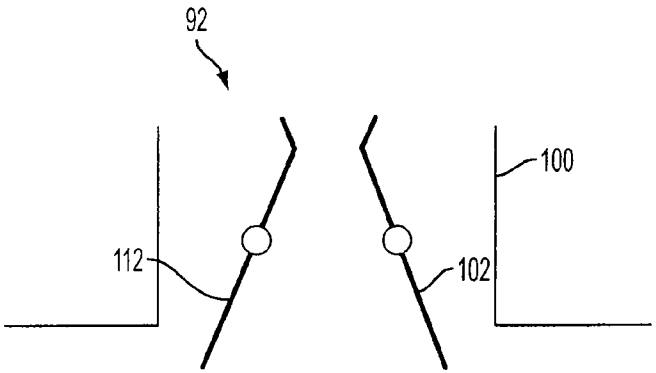
Figure 2D:
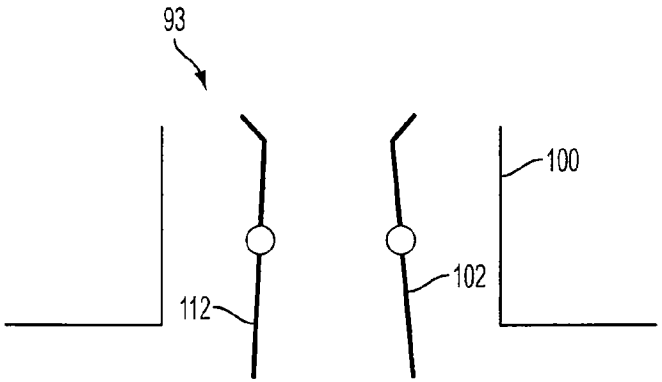

Referring to FIG. 1, a balancing damper in a duct segment 100 that carries grease laden fumes has two generally air blocking elements 102 and 112 that rotate on bearings 108A and 108B. As illustrated in FIGS. 2A to 2D, the blocking elements 102 and 112 rotate symmetrically between settings for high resistance 90, low resistance 93, and a range of positions in-between including those indicated at 91 and 92 positions.

Note that in all of the positions shown, the blocking elements 102 and 112 remain at a minimum angle with respect to the horizontal 80 of more than about 45 degrees, for example, end portions 113 of blocking elements 102 and 112 as well as the major portions 115 all form angles, such as angles $\phi_1$ and $\phi_2$. For example the minimum angle can be at least about 45 degrees, the closed position being the least vertical.

A motor drive 104 may be used to rotate the blocking elements 102 and 112. The drive 104 may include an indicator 114 that shows the position of the damper. The drive 104 may be replaced by a manual positioning device. A synchronization mechanism, such as a kinematic mechanism (for example, one using linkages including the links 106 and 109) may be provided to cause the blocking elements 102 and 112 to pivot back and forth in synchrony. Such a kinematic mechanism could employ gears, hydraulic couplings, electronically synchronized drives or any suitable mechanism.

The blocking elements may be planar or any other suitable shape. The embodiment of FIG. 1 may be modified to fit in a round duct with blocking elements shaped as cylindrical sections to permit the same overall effect as the embodiment of FIG. 1.

Figure 4A:
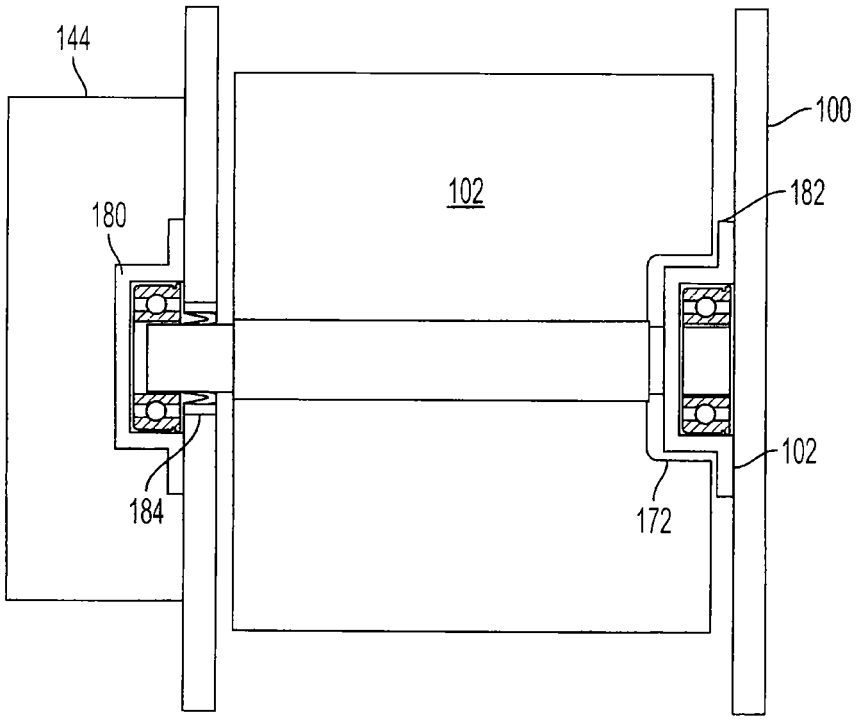
FIG. 4A shows a partial section view of a balancing damper assembly.
Figure 4B:
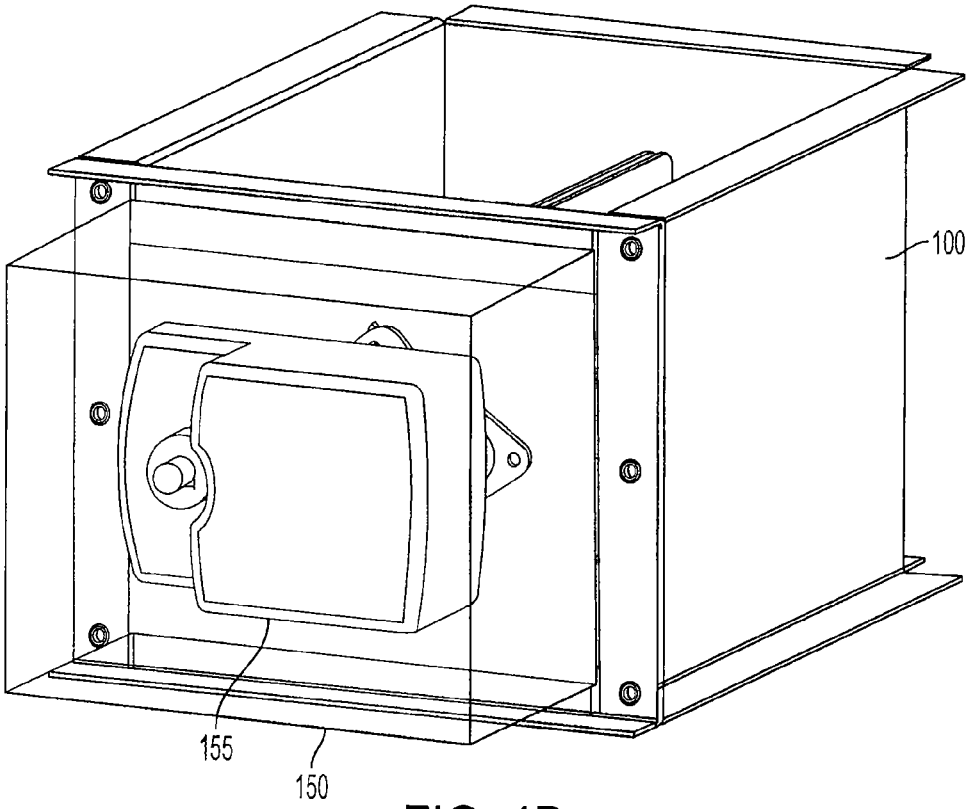
FIG. 4B shows a perspective view of a balancing damper.

Preferably, bearings are provided, such as bearings 108*a* and 108*b*, to support the blocking elements 102 and 112 for pivoting. The bearings may be located inside the duct section 100 or outside. In one configuration, bearings may be located on the inside on a side of the duct opposite the drive motor and on the outside on the side with the drive motor. In the latter configuration, the duct can be located with the side opposite the drive motor lying directly against the wall. Referring to FIG. 4A, where the bearings are located outside as indicated by 180, the duct section may have a housing 144 to enclose the external bearing. The bearings may also be provided with a seal 184 to ensure that gas, grease or condensed vapor or any other liquid cannot leak from the duct. FIG. 4B illustrates a configuration in which a housing 150 encloses a drive 155 as well as the externally-mounted bearing. Bearings 182 inside the duct may be constructed, as shown in FIG. 4A, such that no duct wall penetration is required. Preferably, a notch 172 in blocking element 102 provides clearance for any internal bearing.

Figure 3:
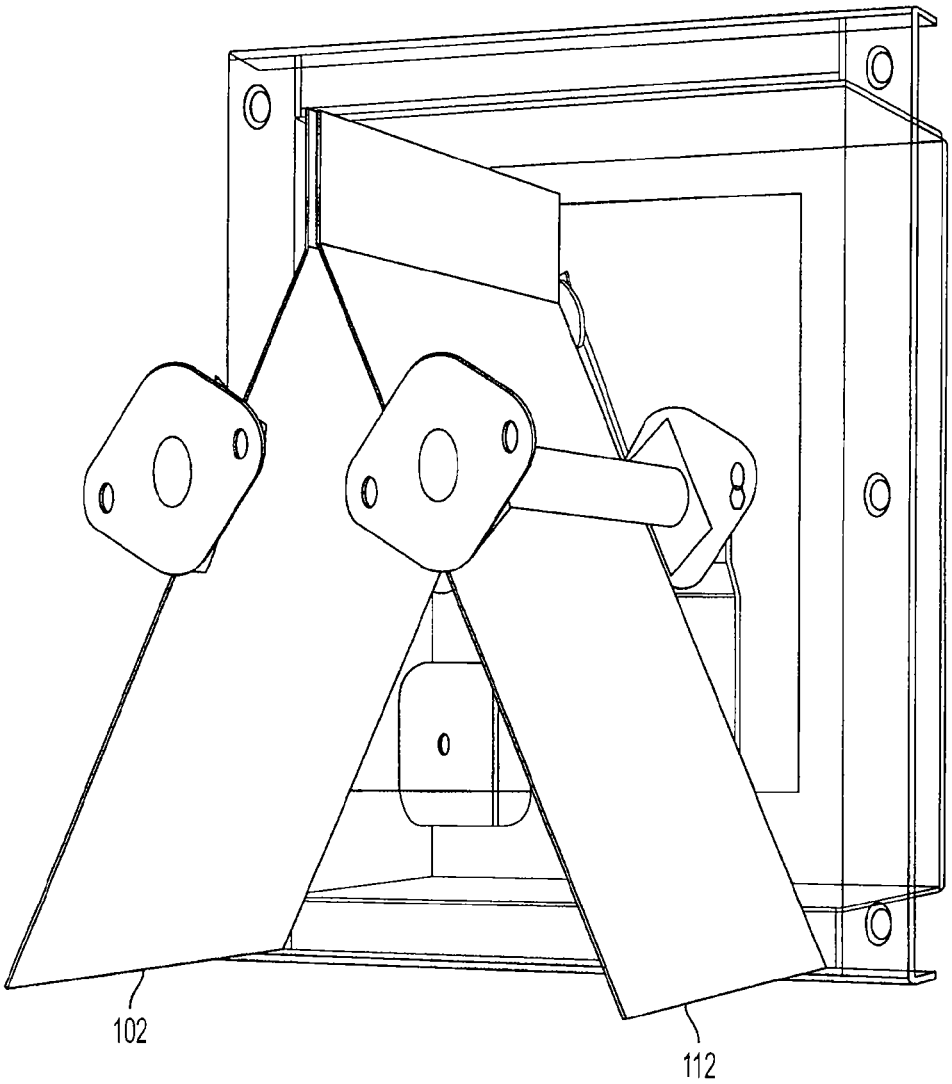
FIG. 3 shows the blades of a balancing damper.
Figure 5A:
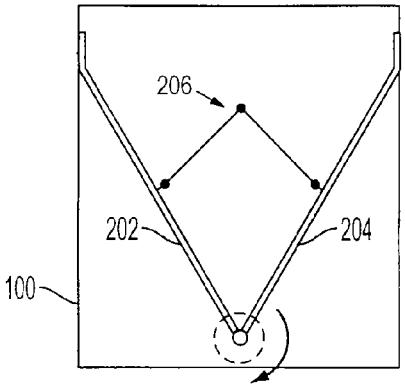
FIGS. 5A-5D show alternative damper blade configurations and mechanisms.
Figure 5B:
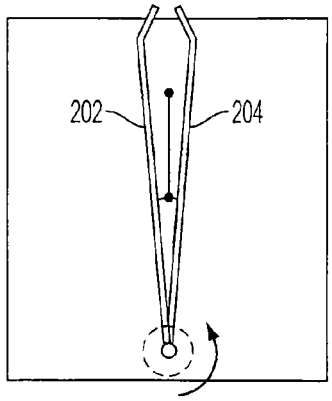
Figure 5C:
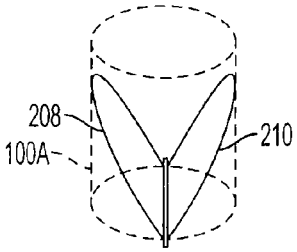
Figure 5D:
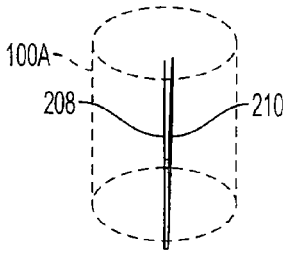

As illustrated, one end of each blocking element 102 and 112 may have a bend at the end. This may enhance rigidity and also help to act as a stop to prevent the blocking elements pivoting too far. Such features may be provided on one or both ends or not at all. FIG. 3 shows the damper with the duct section 100 removed. FIGS. 5A to 5D show alternative mechanisms. FIGS. 5A and 5B show blocking elements 202 and 204 that pivot at their ends. In other configurations, the pivot location may be anywhere along the blocking elements. As in the other configurations, the blocking elements are partially vertical, preferably at least 45 degrees to the horizontal, in the closed position (FIG. 5*a*) and more vertical in the open position (FIG. 5*b*), to help prevent the accumulation of grease by encouraging grease to drip quickly off the blocking elements 202 and 204. A linkage 206, which may be located outside the duct 100, causes the blocking elements 202 and 204 to move in synchrony. An embodiment of FIGS. 5C and 5D has blocking elements 208 and 210 configured for a round duct 100A.

Figure 6A:
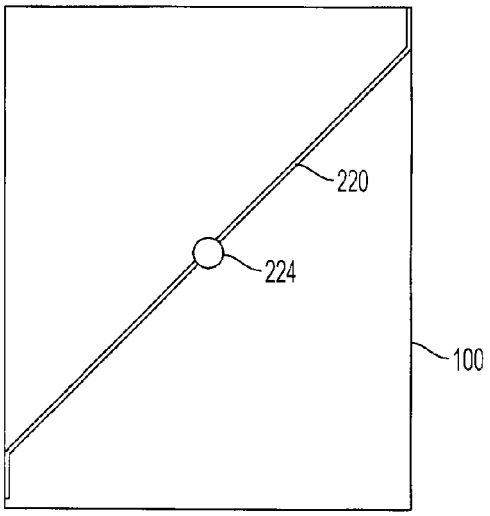
FIGS. 6A and 6B show another alternative blade configuration.
Figure 6B:
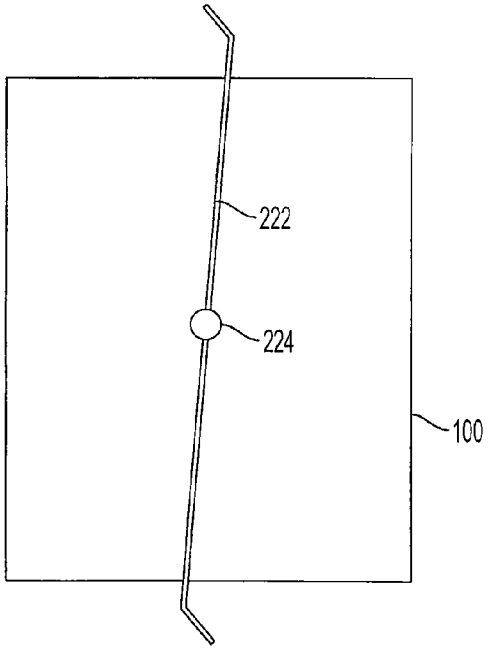

FIGS. 6A and 6B show closed and open positions, respectively, of a mechanism with a single blocking element 220 that pivots at 224. As in the above embodiments, in the closed position, the blocking element 220 forms a substantial minimum angle with the horizontal. In this and other embodiments the minimum angles are as discussed above with regard to the other embodiments.

The above embodiments may be varied in terms of details, such as the shape of the blocking elements and the angle formed by the blocking elements in all positions, even the closed position. For example, although in the above embodiments, the blocking elements form a 45 degree angle, a greater or smaller angle may be used. In preferred embodiments, the angle is at least 30 degrees from the horizontal. In more preferred embodiments, the angle is at least 40 degrees, and more preferably 45 degrees to the horizontal. In alternative embodiments, the angle is greater than 45 degrees to the horizontal.

Note in the above embodiments that the blocking elements have bent portions at one or more edges. These also form substantial angles with the horizontal in all positions. Preferably the angles are greater than 45 degrees.

Figure 8:
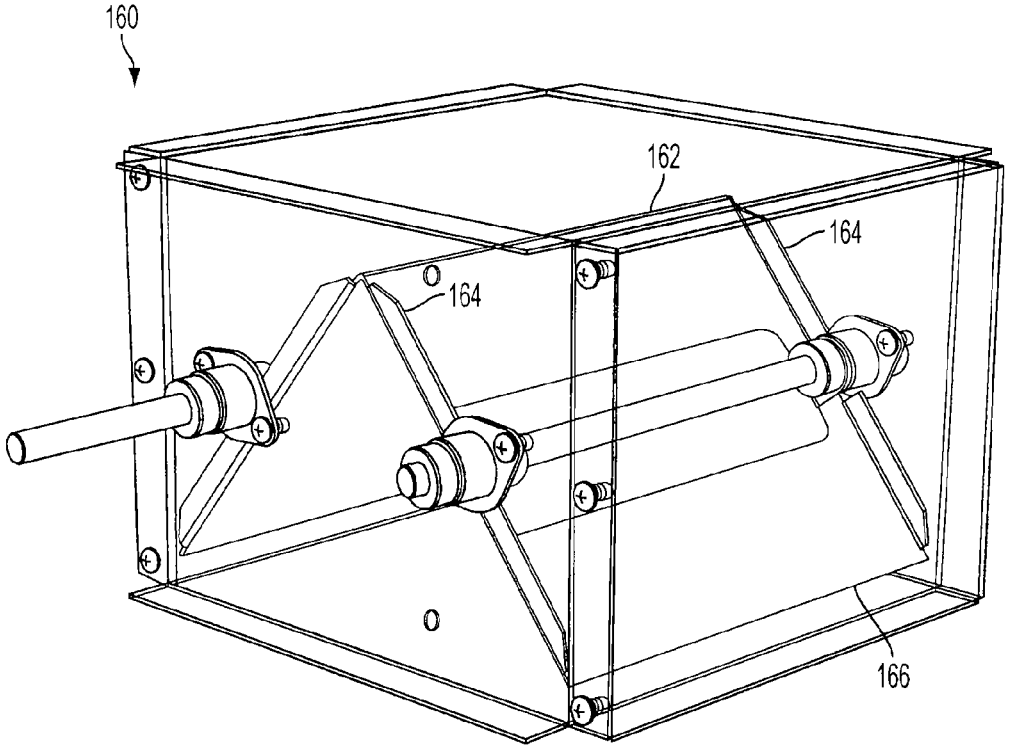
FIG. 8 shows a configuration of a damper with trough shaped blades.

FIG. 8 shows a damper configuration 160 with damper blocking elements that are trough shaped with bends 164 providing rigidity and no bends on the upstream 166 and downstream 162 edges. The bends 164 can extend the entire distance between the edges 162 and 166 or they can be interrupted, as shown, at one or more points along that distance.

Figure 7:
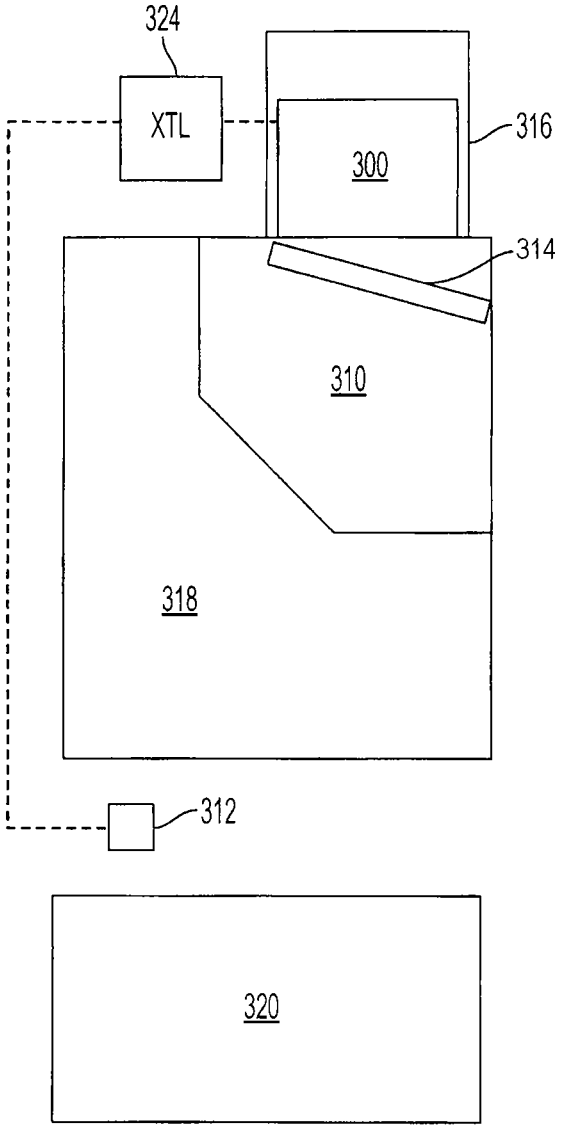
FIG. 7 shows a damper unit mounted in a duct of an exhaust hood and various associated features.

Referring to FIG. 7, preferably, grease conveyance 314 is provided below the damper 300 to carry grease that drips from the damper unit 300. FIG. 7 shows the damper unit 300 mounted in a duct 316 of an exhaust hood 318 above an exhaust plenum 310. The exhaust hood 318 is mounted over an appliance 320 that emits fumes. A controller 324 controls the damper unit 300 responsively to an indicator 312 which indicates the conditions of the exhaust stream or the operational state of the appliance 320. In a preferred configuration, when the appliance 320 is on, the damper 300 is controlled by a controller 324 such that it never fully closes and continues to drain grease generated by the appliance back into the hood grease conveyance or the plenum, depending on the configuration. However, when the appliance is off, the damper fully closes to seal the ductwork to prevent outside air from getting pulled back into the ductwork and into the interior space in which the exhaust hood 318 is located. It is believed that this provides the benefit of reducing the load on any space conditioning system responsible for maintaining enthalpy conditions in the interior space. The indicator 312 may include a cooking sensor (such as an infrared sensor, direct communication with the appliances, etc.), gas sensor, opacity sensor, temperature sensor or any device that can indicate whether exhaust flow is required to eliminate fumes. Loads can be detected in other indirect ways, for example by detecting the fuel or electricity consumed by an appliance, the time of day, or the number of orders placed for cooked food.

U.S. Pat. Nos. 6,170,480 and 6,899,095, which are hereby incorporated by reference as if fully set forth in their entireties herein, illustrate various ways to detect the amount of fumes in an exhaust system that may be used to control the damper units of the above embodiments. These documents also discuss applications for a damper, such as balancing of hoods mounted to a common exhaust. The embodiments of the invention can be used with these applications.

It is, therefore, apparent that there is provided, in accordance with the present disclosure, a damper suitable for liquid aerosol-laden flow streams and associated methods. Many alternatives, modifications, and variations are enabled by the present disclosure. Features of the disclosed embodiments can be combined, rearranged, omitted, etc. within the scope of the invention to produce additional embodiments. Furthermore, certain features of the disclosed embodiments may sometimes be used to advantage without a corresponding use of other features. Accordingly, Applicants intend to embrace all such alternatives, modifications, equivalents, and variations that are within the spirit and scope of this invention.

The invention claimed is:

1. A flow control device, comprising:

a duct section with a plurality of damper blocking elements, each having a major plane;

the damper blocking elements being pivotably connected to the duct section and movable in a range that is limited to ensure that, when the duct section is mounted in a preferred orientation, each of the damper blocking elements major plane always forms an angle of at least 45 degrees from the horizontal throughout the range;

the range being such that the plurality of damper blocking elements can selectively, substantially close and open the duct section;

a motor drive configured to position the damper blocking elements; and a controller configured to control the motor drive responsively to a fume load detected by at least one of a gas sensor, an optical sensor, a temperature sensor, and a flow sensor, wherein the plurality of damper blocking elements is two damper blocking elements which are interconnected to pivot in opposite directions such that edges thereof meet in the middle of the duct section when the blocking elements are in a closed position and such that the major planes are substantially vertical when the blocking elements are in an open position, and the damper blocking elements pivot on bearings mounted inside the duct section on one side of the duct section and mounted outside the duct section on an opposite side of the duct section such that the one side has no protrusions.

2. The device of claim 1, wherein the plurality of damper blocking elements is two damper blocking elements.

3. The device of claim 1, wherein the plurality of damper blocking elements is two damper blocking elements which are interconnected to pivot in opposite directions such that edges thereof meet in the middle of the duct section when the blocking elements are in a closed position and such that the major planes are substantially vertical when the blocking elements are in an open position.

4. The device of claim 3, wherein the blocking elements have flat portions that come into parallel abutment with each other when the blocking elements are in the closed position.

5. The device of claim 1, wherein the damper blocking elements pivot on bearings mounted outside the duct section.

6. The device of claim 5, further comprising shafts that carry the blocking elements which are mounted to the bearings, and liquid proof seals that permit the shafts to rotate while preventing fluid in the duct section from escaping to outside of the duct section.

7. The device of claim 1, wherein the damper blocking elements are supported by bearings located outside the duct section, the duct section being sealed to prevent fluid within the duct section from escaping therefrom.

8. The device of claim 1, wherein the damper blocking elements pivot on bearings mounted inside the duct section on one side of the duct section and mounted outside the duct section on an opposite side of the duct section such that the one side has no protrusions.

9. The device of claim 8, wherein the motor drive is located on the opposite side.

10. The device of claim 1, wherein the blocking elements have flat portions that come into parallel abutment with each other when the blocking elements are in the closed position.

11. A flow control device, comprising:

a duct section of an exhaust duct connected to an inlet for fumes from an exhaust hood mounted over an appliance with a plurality of damper blocking elements, each having a major plane;

the damper blocking elements being pivotably connected to the duct section and movable in a range that is limited to ensure that, when the duct section is mounted in a preferred orientation, each of the damper blocking elements major plane always form an angle of at least 45 degrees from the horizontal throughout the range;

the range being such that the plurality of damper blocking elements can selectively, substantially close and open the duct section;

a motor drive configured to position the damper blocking elements; and a controller configured to control the motor drive responsively to a fume load detected by an indicator indicating whether an exhaust flow in said duct section is required to eliminate fumes and includes at least one of a gas sensor, an optical sensor, a temperature sensor, and a flow sensor, the indicator being positioned to permit it to detect fumes from the appliance;

the controller further being configured such that when the appliance is off, the damper blocking elements fully close to seal the duct section to prevent outside air from getting pulled back through the duct section, wherein each blocking element is connected to the bearings for pivoting from a pivoting location located between ends of each blocking element such that they pivot from their middles.

* * * * *